United States Patent [19]

Courtois et al.

[11] Patent Number: 4,807,843

[45] Date of Patent: Feb. 28, 1989

[54] RECESS PLUG FOR PRECAST CONCRETE PANELS

[75] Inventors: Peter D. Courtois, Centerville, Ohio; Robert E. Truitt, Carson, Calif.

[73] Assignee: Dayton Superior Corporation, Miamisburg, Ohio

[21] Appl. No.: 130,698

[22] Filed: Dec. 9, 1987

Related U.S. Application Data

[63] Continuation-in-part of Ser. No. 29,305, Mar. 23, 1987, abandoned.

[51] Int. Cl.[4] ..... B28B 7/16

[52] U.S. Cl. ..... 249/61; 52/98; 52/125.4; 52/699; 249/95; 249/96; 249/177; 249/184; 294/89

[58] Field of Search ..... 249/35, 40, 63, 91, 249/93–97, 177, 184, 185, 186, 217, 219 R; 52/98, 125.1, 125.4, 125.5, 576, 698, 699, 701, 704, 706, 707, 711; 294/89, 90

[56] References Cited

U.S. PATENT DOCUMENTS

| | | | |
|---|---|---|---|
| 960,625 | 6/1910 | Cowles | 52/711 |
| 1,146,686 | 7/1915 | Branch | 52/711 |
| 4,000,591 | 1/1977 | Courtois | 52/125.4 |
| 4,133,154 | 1/1979 | Ruzicka | 52/704 |
| 4,296,909 | 10/1981 | Haeussler | 52/125.4 |
| 4,671,554 | 6/1987 | Lancelot | 294/89 |
| 4,700,979 | 10/1987 | Courtois et al. | 294/89 |

FOREIGN PATENT DOCUMENTS 2167274 8/1973 France

OTHER PUBLICATIONS

Front cover & pp. 24–27 of "Tilt-Up Construction Handbook", pub. 1984.

Print of Dayton Superior Corporation Drawing entitled "GRSL Void Former", dated 6/13/81.

*Primary Examiner*—Jay H. Woo

*Assistant Examiner*—James C. Housel

*Attorney, Agent, or Firm*—Biebel, French & Nauman

[57] ABSTRACT

A recess plug for positioning lifting anchors in precast concrete panel includes first and second hollow plug halves having complementary, frictionally-engaging mating surfaces, and also having pairs of projecting bosses positioned to overlap, when the plug halves are joined together, such that holes therethrough are in registry to receive nails therethrough for locking the plug halves together in enclosing relation with the head of an anchor as they are mounted on a vertical formwork wall. The plug halves also include boss portions for attaching a reinforcing bar to the plug assembly so that the reinforcing bar is properly positioned relative to the anchor held by the recess plug to bear the stresses applied to the anchor when the panel is lifted by the anchor. Each plug half includes a rear wall having a notch which forms an opening with the notch in the mating plug half sized to receive the shank of an anchor therethrough. The interior of each plug half is hollow and includes a pair of webs spaced apart to receive the shank of an anchor and including cutouts to receive an anchor head. The cutouts, webs and opening enable the recess plug to hold a lifting anchor firmly in cantilevered relation to the form wall on which the plug assembly is mounted without movement of the anchor relative to the plug during formwork set-up and concrete pouring of the precast concrete panel. Then after the formwork is dismantled, the plug is torn away to expose the anchor head for tilt-up use.

5 Claims, 4 Drawing Sheets

RECESS PLUG FOR PRECAST CONCRETE PANELS

REFERENCE TO RELATED APPLICATION

This application is a continuation-in-part of our application Ser. No. 029,305, filed Mar. 23, 1987 and now abandoned.

BACKGROUND OF THE INVENTION

The present invention relates to the fabrication and handling of precast concrete panels such are used in "tilt-up" construction and in forming other types of structures, such as retaining walls. Concrete panels of this type are generally flat and are formed by pouring concrete into a relatively shallow, horizontally-oriented mold, allowing the concrete to set, and then removing the panel from the mold. Such panel casting may be carried out at a central plant, but it is most often done using molds made from wooden forms at the job site.

The invention is specifically directed to the fabrication of such panels, which may weigh many tons, wherein lifting anchors are cast into one end or side edge of the panel. A lifting anchor includes an elongated shank having an enlarged foot by which it is anchored inside the panel, and an enlarged head which is positioned within a recess formed in the edge of the panel. Lifting hardware designed to grasp the recessed head of the anchor includes bails which accept crane hooks, so that a concrete panel can be lifted by its anchors utilizing a standard crane hook. An example of such ground release hardware is disclosed in our commonly assigned U.S. Pat. No. 4,700,979.

When an anchor is cast within a tilt-up panel, it is desirable to position the anchor with its head spaced inside the edge face of the panel, in a recess formed during the casting process. After the precast panel has been moved to its final position, by means of lifting hardware and the anchors, the recess can be easily patched to avoid rusting of the anchor and resulting surface staining of the concrete surrounding the anchor head.

Recess plugs are commonly used both to form hemispherical recesses in the panel and also to hold the anchor in the proper recessed position relative to the panel formwork during the concrete casting process. An example of such a recess plug is disclosed in Haeussler U.S. Pat. No. 4,296,909 of 1981 and includes a pair of quarter-spherical plug parts which are attached to each other by a hinge assembly that also supports a threaded rod. Each of these half-plug parts has a flat front wall for abutting a flat formwork face, and the threaded rod extends perpendicularly through a hole in the formwork so that the plug can be attached to the formwork by threading a nut onto the bolt on the outside of the formwork. Each of the plug halves includes a notch leading into an interior recess, and when they are joined together, these notches and recesses define a cavity which is shaped to receive the flared head and adjacent portion of the shank of a lifting anchor.

When the plug is attached to the wall of a formwork section, the engagement with the wall clamps the halves together and holds them around a lifting anchor so that the anchor extends perpendicularly to the formwork wall. After the concrete is poured into the form and hardens, the formwork is stripped away, and the plug is removed to leave the anchor head positioned within a hemispherical recess.

A disadvantage with recess plugs of this type is that they lack means for positioning reinforcing bar means in the panel which will be in the proper relation to the head of each lifting anchor, since it is this region of the panel which must bear the shear forces that the lifting structure imposes on the concrete as the panel is being tilted up from a horizontal position. More specifically, the lifting force applied to the anchor at the beginning of a tilt-up operation is translated into a severe shear force imposed on the concrete lying between the head and adjacent shank portion of the anchor. Unless this force is transferred to the mass of concrete lying below the anchor, spalling and cracking of the edge portion of the panel is likely to occur.

There is therefore a need in the industry for recess plugs which are relatively inexpensive to manufacture, which will function to locate reinforcing bars in properly close relation to each lifting anchor, and which can be attached directly to formwork without having to drill relatively large bore holes through the formwork, as with the plugs of the above Haeussler patent. Not only does this require additional labor, but formwork used for different jobs may require different locations for the lifting anchors, and previously bored holes which are not used for the next job must be patched in order to prevent leaking of concrete through the holes and corresponding defacing of the surface of the panel.

SUMMARY OF THE INVENTION

The present invention provides a recess plug for attachment to the inside of wooden formwork for casting a tilt-up panel without having to drill through any form, and which will support a lifting anchor extending horizontally from the form and also a reinforcing bar in the optimum spatial relation with the anchor.

The recess plug of the present invention consists of a pair of identical plug elements or parts, each of which defines one half of a hemisphere, and these parts have complementary mating portions which frictionally lock them together in enclosing relation with the head of a lifting anchor. Each of these twin plug parts is also formed on its spherically curved surface with a portion or portions which will receive and hold a reinforcing bar prior to the pouring of the panel so that this bar will be in properly located relation with the lifting anchor and the adjacent surface in the finished panel.

Each plug part includes a semi-circular flat front face that engages the formwall to which it is attached in use, and it also includes projecting bosses coplanar with its front face for receiving nails by which it is attached to the form in fixed relation with its twin part. In a preferred form of the invention, each plug part includes, at the ends of the straight side of this front face, an outwardly projecting boss having a hole therethrough, and when the two plug parts are joined, these bosses overlap and bring these holes into registry to receive nails therethrough which thus lock the two parts of the plug assembly together as it is mounted on a form.

Each of the two component parts of each plug assembly is molded of suitable plastic, such for example as High Density Polyethylene, with a thin wall to provide a hollow interior which is open on its side that joins the other half of the hemi-spherical plug assembly so that the two plug elements can be joined together in enclosing relation with the head and adjacent portion of the shank anchor. By providing a relatively hollow recess plug in which the anchor head is engaged only by webs inside the plug assembly, great initial savings in material are realized, thereby justifying one-time use terminated by destruction of the plug parts in the course of removing them from the cast panels.

These and other advantages of the invention, and the means by which they are achieved, are pointed out in the course of the description of the preferred embodiments of the invention which follows.

DETAILED DESCRIPTION OF THE PREFERRED EMBODIMENTS

Figure 4:
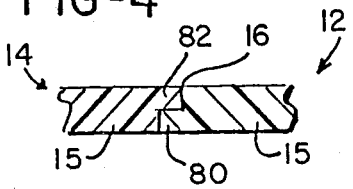
FIG. 4 is an enlarged fragmentary view taken in section on the line 4—4 of FIG. 1.
Figure 5:
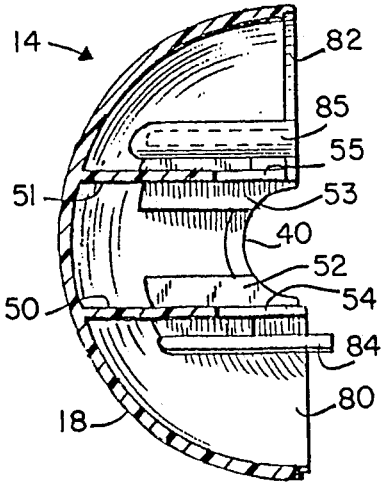
FIG. 5 is a section through one of the plug elements of FIGS. 1–4, the view being taken on the line 5—5 of FIG. 6.
Figure 6:
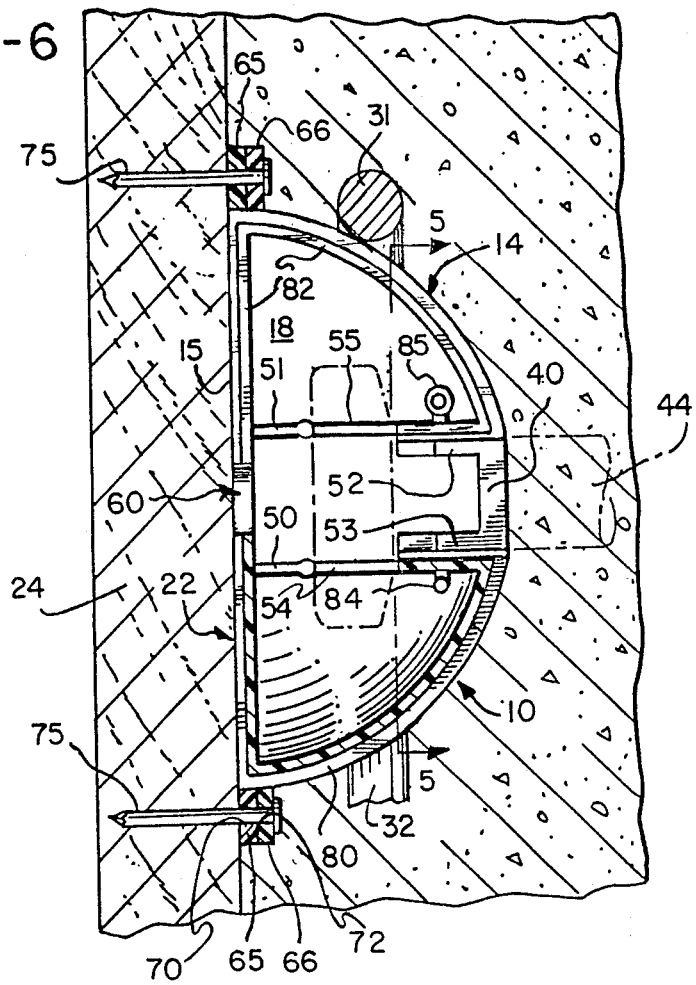
FIG. 6 shows the assembly of FIG. 1 attached to formwork and set in the cast concrete panel, the view being in section on the line 6—6 of FIG. 1 and with the lifting anchor shown in phantom.

The recess plug assembly shown in FIGS. 1–6, which is generally designated 10, includes a pair of twin quarter-spherical plug elements 12 and 14 which are identical in shape and construction, and which are interconnected to form the two halves of the assembly 10. Each of the elements 12 and 14 includes a semi-circular wall 15, which has a straight edge 16, and a quarter-spherical rear wall 18, which is contiguous with the front wall 15 along their common semi-circular edge 20. The front walls 15 of elements 12 and 14 combine to form a disk-shaped circular face 22 which fits flat against a formwork wall 24 in the use of the plug assembly as illustrated in FIG. 6.

Each of the plug elements 12 and 14 includes a pair of tabs 25–26 extending outwardly from the mid-point rear wall 18 thereof and spaced apart sufficiently to define a recess 27 for receiving a section of reinforcing bar 30 therein with a friction fit. The reinforcing bar 30, as shown in FIG. 5, preferably has a U-shape comprising a loop 31, parallel sections 33 which are spaced to engage between the tabs 25 of the elements 12 and 14 respectively, and linear segments 35 extending outwardly from the parallel sections.

It is important that the tabs 25 be so positioned with respect to the plane of the face 22 as to assure that there be a sufficient thickness of concrete between the reinforcing bar 30 and the adjacent surface of the concrete panel, e.g. not less than substantially 0.75 inch. Accordingly, the tab 25 should be located with its inner surface 0.75 inch from the plane of face 22, both tabs 25–26 should be ½ inch wide, and with the recess 27 should have a width of 7/16 inch for reinforcing bar 30 which is 0.444 inch in diameter.

Figure 3:
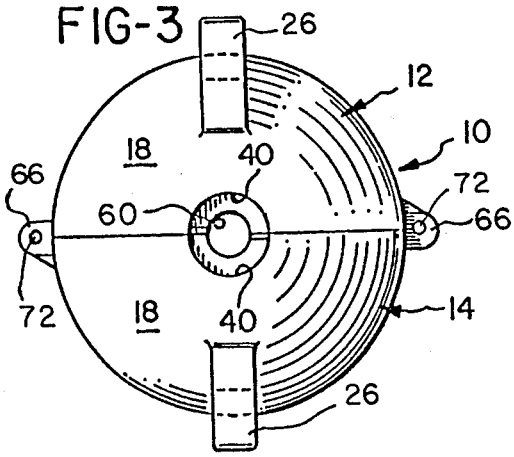
FIG. 3 is an end view of the recess plug looking from right to left in FIG. 2 and with the reinforcing bar removed.
Figure 8:
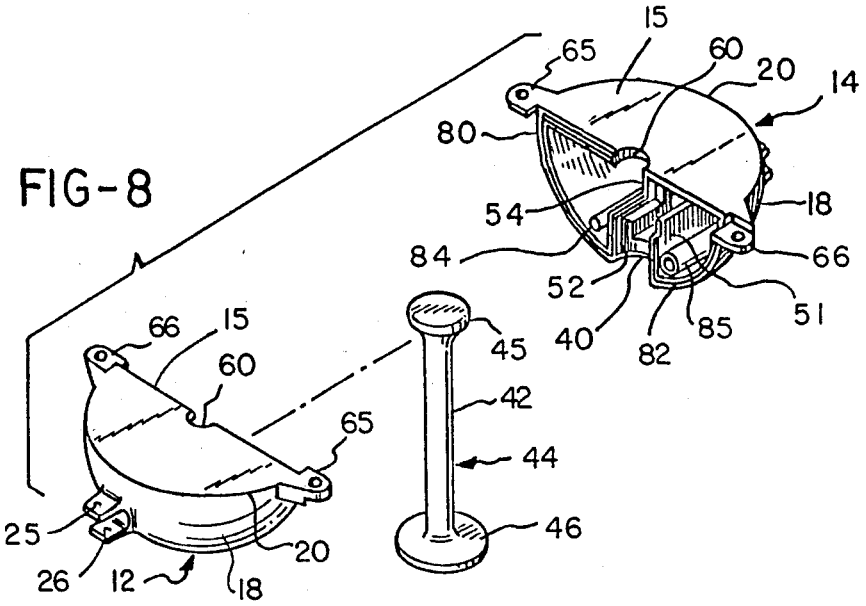
FIG. 8 is an exploded perspective view of the recess plug assembly of FIG. 1.

As shown in FIGS. 5 and 8, each of the plug elements or halves 12 and 14 is a thin-walled (e.g 7/64 inch in thickness) structure having a hollow interior. Each rear wall 18 includes a semi-cylindrical notch 40 at the mid-point of its open curved edge, and when the two plug elements are joined together as shown in FIGS. 3 and 4, the notches form a cylindrical opening sized to receive therethrough the shank 42 of a lifting anchor 44 which also has a flared head 45 and an enlarged foot 46.

Each plug element is constructed internally to provide portions which enclose and retain the anchor head 45 while also bracing the thin exterior walls of the element. More specifically, a pair of parallel webs 50 and 51 extend inwardly from the rear wall 18 and front wall 16 of each plug element to positions straddling the notch 40. These webs 50 and 51 are spaced to receive the anchor shank 42 therebetween, and each includes a thickened outer portion 52–53 respectively for strengthened resistance to the bending moments applied by the anchor 44 when in use. In addition, the webs 50 and 51 are provided with notches 54 and 55 in their exposed edges which are sized to receive and retain the anchor head 45, as shown in dotted lines in FIG. 5.

Figure 1:
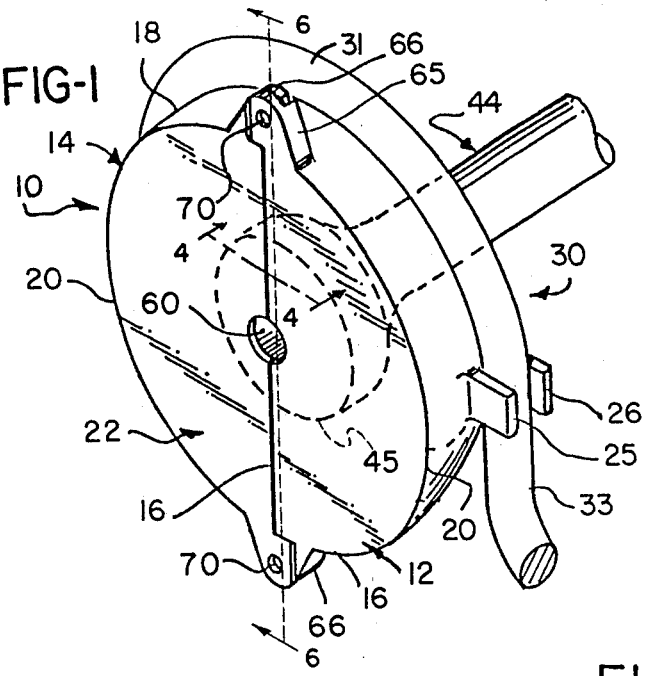
FIG. 1 is a perspective view of a recess plug assembly of the present invention, shown engaging a lifting anchor and reinforcing bar.
Figure 2:
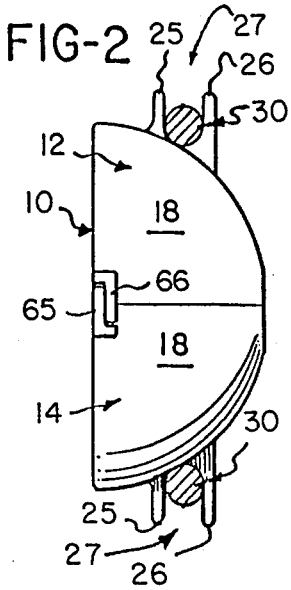
FIG. 2 is a view of the plug assembly and reinforcing bar of FIG. 1 which is taken looking from left to right in FIG. 3.

The front wall 15 of each of the plug elements 12 and 14 includes a semi-cylindrical notch 60 which is concentric with but smaller than the notch 40. These notches combine in the assembled form of the plug to define an opening in the face 22 of the plug, as shown in FIG. 1, which is sized to receive a tool, such as the tip of a screwdriver or the claw of a hammer, for prying the plug elements out of the cast panel after the formwork has been removed.

Figure 9:
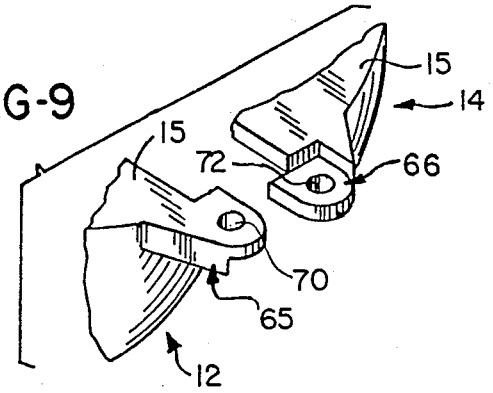
FIG. 9 is a fragmentary perspective view of the interconnecting bosses on the plugs of FIGS. 1 and 8.

Each of the plug elements 12 and 14 includes projecting bosses 65 and 66 at the opposite ends of the straight edge 16 of its front wall 15. As best shown in FIG. 9, these bosses are complementary, in that the boss 65 has its upper surface coplanar with the plug surface 22 but extends across the projection of the straight side of wall 15, while the boss 66 is complementarily configured to fit under the boss 65 when the two plug halves are assembled together. In addition, the boss 65 has a through hole 70 which lines up with a similar hole 72 in the boss 66 in the assembled condition of the two plug elements to receive a nail 75 by which the plug assembly is mounted on formwork as described in detail hereinafter.

The plug parts 12 and 14 include additional complementary portions which frictionally interfit to hold them together in assembled relation. As best shown in FIGS. 5–6, each plug element includes a narrow flange 80 which extends from notch 40 to notch 60 on one half of its open edge and projects beyond but at a lower level from the straight edge 16 of its front wall 15. On the other half of that edge 11, each plug element is undercut at 82 to form the complement or negative of the flange 80. Thus when the two parts are pressed together, the flange 80 on each part will enter the undercut 82 on the other part to provide both a sealing and a frictionally retaining action therebetween.

An additional frictional interlock between the two assembled plug elements is provided by a pair of interfitting pin and barrel interlocks. More specifically, each element includes a pin 84 which is located on the outside of web 50 and projects beyond the plane defined by the flange 80. On the opposite side of the web 51 is a barrel 85 positioned and proportioned for frictionally receiving the pin 84 on the other plug element as the parts are forced together to complete a plug assembly 10.

In the use of the invention, two plug elements 12 and 14 are first assembled around the head 45 of an anchor 44 and pressed together to the condition illustrated in FIG. 1 wherein the flanges 80 and undercuts 82, and also the pins 84 and barrels 85, frictionally interfit to hold the plug assembly together on the anchor. Enough of these assemblies are completed and accumulated for each panel to be cast, and each assembly is attached to a wall 24 of formwork 88 by driving nails 75 through the aligned holes in the overlapping bosses 65 and 66.

Figure 7:
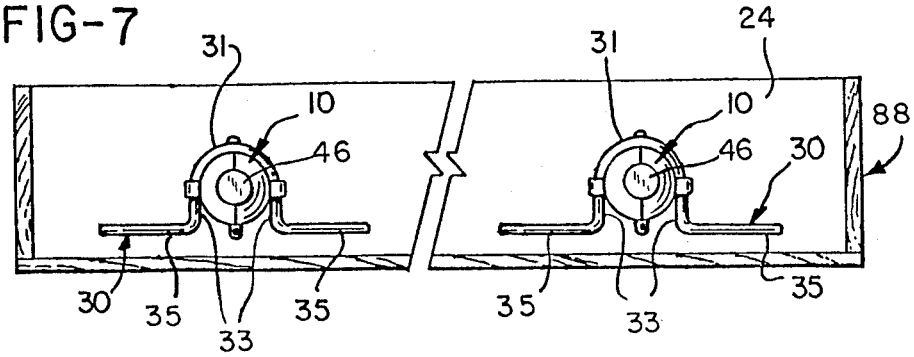
FIG. 7 is a somewhat schematic view showing recess plug assemblies of the type shown in FIG. 1 mounted on formwork together with reinforcing bars.

At this stage of their use, each of the plug assemblies 10 will hold its associated anchor 44 in firm cantilevered relation with the formwork wall to which it is attached. After the necessary number of assemblies have been secured to the formwork, a reinforcing bar 30 is mounted on each assembly 10 by means of the tabs 25–26 as previously described, and as shown in FIG. 7. These reinforcing bars, as well as the flared feet 46 of the anchors, may also be wired to other reinforcing structure inside the mold, if desired. The concrete 90 is then poured and caused to harden.

After the panel has hardened, the formwork is stripped away, and this will automatically separate the formwork from the plugs 10, since the nails 75 readily pull out of the wood formwork. The plug assembly 10 may then be removed from the hardened concrete by inserting an appropriate tool into the opening formed by each pair of mating recesses 60, and prying the plug parts out of the recess in the edge of the panel, which usually results in breaking the plug parts.

This leaves the recess formed by the plug assembly with the anchor head 45 exposed therein for ready access by whatever lifting hardware is to be used for the subsequent handling of the panel, and with the reinforcing bars 30 properly positioned around the anchor head. The portions of the plug parts which supported these bars usually pull out of the concrete, but even if they break off, that is immaterial because they will be buried when the recess is patched.

Figure 10:
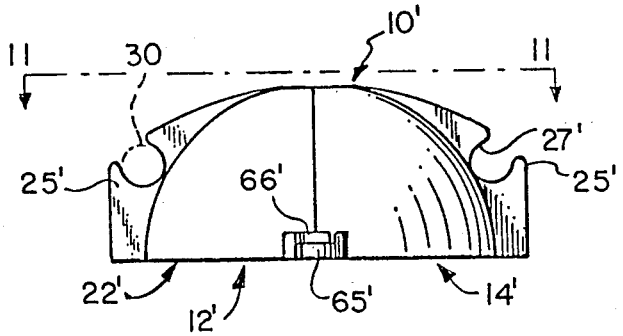
FIG. 10 is a side elevational view of an alternate embodiment of the recess plug of the present invention, looking from left to right in FIG. 11.
Figure 11:
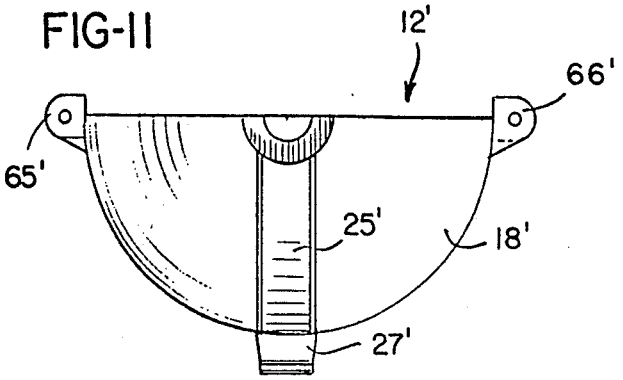
FIG. 11 is a view of one of the parts of the plug shown in FIG. 1, looking as indicated by the line 11—11 in FIG. 10.

An alternative construction of the plug of the invention is shown in FIGS. 10–11. This plug 10′ is identical in every respect to the plug 10 shown in FIGS. 1–9, except that in place of the tabs 25 for mounting reinforcing bar, each plug half is formed with a radially projecting boss 27′ approximately 0.50 inch in thickness which is provided with a cylindrically curved notch 26′ sized to receive a reinforcing rod 30 with a snap fit therein, i.e. with an angular extent of slightly more than 180°, and a diameter of 7/16 inch for rod 30 which is 0.444 inch in diameter. This notch 27′ should also be properly located with respect to the plane of flat surface 22′ as already explained, i.e. without the minimum distance therebetween of 0.75 inch. The use of this plug 10′ is identical to that of the plug 10 as already described.

Figure 12:
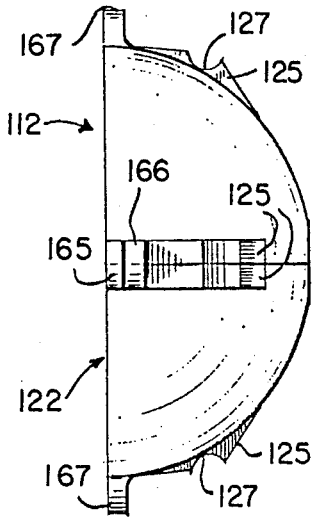
FIG. 12 is a view similar to FIG. 2 showing another form of plug assembly of the present invention.
Figure 13:
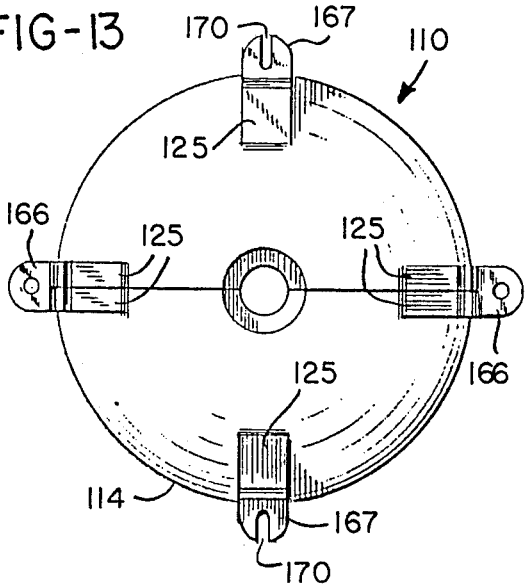
FIG. 13 is a view looking from right to left in FIG. 12.

The further modified construction of plug assemblies shown in FIGS. 12 and 13 provides a solution to a practical problem which has been observed in the field with the plug assemblies of FIGS. 1–9. More specifically, and as illustrated in FIG. 7, when those plug assemblies are installed on formwork with the bosses 65–66 defining a vertical plane, the tabs 25 will be on opposite sides of each plug assembly and define a horizontal plane, which makes it easy to mount a reinforcing bar 30 therein in the preferred orientation, with its long segments 35 extending parallel with the long dimensions of the panel. Another practical advantage is then that in order to remove the plug assembly, the workman can readily insert an appropriate tool, such particularly as the claw of a hammer, in the hole defined by the notches 60 and thereby to remove the plug assembly from the recess formed thereby.

If, however, a workman should by carelessness install the plug assembly in a position rotated 90° in either direction from the position shown in FIG. 7, there will then be only one pair of notches available for use, namely the pair on top of the plug assembly, and this will not provide a stable mounting for the reinforcing bar. The plug assembly 110 shown in FIGS. 12 and 13 is designed to minize the possibility of this result.

More specifically, except as noted below, the plug assembly 110 is identical in every respect to the plug assembly 10, and portions thereof are accordingly identified with similar reference characters in the 100's, i.e. plug elements 112 and 114, and so forth. The plug elements 112 and 144 differ, however, in that each is provided with a radially projecting boss 125 both along the mid-points of each spherically curved wall 118, and also at each end thereof, the latter bosses each having one-half thereof on each plug part 112 and 114.

Each of these bosses 125 is provided with a cylindrically curved notch 127 sized to receive a reinforcing rod 30 in a manner similar to the notches 27′ described above in connection with FIGS. 10–11. The location of bosses 125 and notches 127 may be the same as noted in connection with FIGS. 10–11, but the notches 127 have an angular extent of less than 180°, satisfactory results having been obtained with an angular extent of only about 90° by reason of the greater stability provided by the fact that each reinforcing rod will usually be received in three of the notches 127.

One other difference between the plug assemblies 10 and 110 is that each of the plug elements 112 and 114 is provided with a slotted, fork-like projection 167 located at the mid-point of its semi-circular front wall 116, the slot 170 in each of these projections 167 being sized to receive a mounting nail in the same manner as the bosses 165–166. The projections 167 can also be provided with a round nail hole rather than a slot, but the latter is easier to form by molding.

The overall construction of the plug assembly 110 is therefore even easier to use than the plug assembly 10, particularly by an unskilled workman. It also more readily compensates for mistakes in its installation by assuring that whatever its orientation clockwise on a formwork wall may be, it will always provide enough mounting bosses for a reinforcing bar in proper locations to assure that in the finished panel, the bar will be in proper adjacent relation with its associated lifting anchor.

While the forms of apparatus herein described constitute preferred embodiments of the invention, it is to be understood that the invention is not limited to these precise forms of apparatus, and that changes may be made therein without departing from the scope of the invention.

What is claimed is:

1. Apparatus for casting, in a mold defined by vertical wood formwork, a concrete panel having embedded in an edge thereof, a lifting member including an elongated shank and an enlarged head, and for simultaneously holding reinforcing bar means in predetermined relation with said lifting member, comprising:

(a) a pair of essentially hollow, thin-walled, identical plug elements each configured to define a quartersphere having a spherically curved outer wall and two essentially flat sides, (b) one of said flat sides of each of said plug elements defining an essentially semi-circular wall, (c) the other said flat side of each said plug element being open, (d) said edges being curved wall and said flat wall of each said plug element having edges which define said open side of said plug element and are configured for complementary interfitting frictional engagement with said edges of the other said plug element to compose a hemispherical plug assembly sized to enclose said head of said lifting member, (e) said elements having complementary notches in said curved edges thereof located for cooperation to define an opening in the center of said hemispherical wall of said assembly which is sized to encompass said shank of said lifting member closely and thereby to retain said lifting member head within said assembly, (f) means for attaching said plug assembly to said mold vertical formwork with said semi-circular walls of said plug elements engaging the surface of said formwork and with said elements retained in said frictional engagement with each other and in said encompassing relation with said lifting member shank to support said lifting member in cantilevered relation with said formwork, (g) a reinforcing bar having a center portion of U-shape and arms projecting in opposite directions away from said center portion, (h) said center portion defining a semi-circle of inner radius less than the outer radius of said plug assembly, and (i) clip means integrally formed on said hemispherical wall of said plug assembly retaining said center portion of said reinforcing bar thereon in fixed spatial relation with the associated said lifting member and said formwork.

2. Apparatus for use with a lifting, member having an enlarged head and an elongated shank which is embedded in an edge of a cast concrete panel to form a recess around said head during casting of the panel in a mold defined by vertical wood formwork, comprising:

(a) a pair of essentially hollow, thin-walled, identical plug elements each configured to define a quartersphere having a spherically curved outer wall and two essentially flat sides, (b) one of said flat sides of each of said plug elements defining an essentially semi-circular wall, (c) the other said flat side of each said plug element being open, (d) said curved wall and said flat wall of each said plug element having edges which define said open side of said plug element and are configured for complementary interfitting frictional engagement with said edges of the other said plug element to compose a hemispherical plug assembly sized to enclose said head of said lifting member, (e) said elements having complementary notches in said curved edges thereof located for cooperation to define an opening in the center of said hemispherical wall of said assembly which is sized to encompass said shank of said lifting member closely and thereby to retain said lifting member head within said assembly, (f) means for attaching said plug assembly to said mold vertical formwork with said semi-circular walls of said plug elements engaging the surface of said formwork and with said elements retained in said frictional engagement with each other and in said encompassing relation with said lifting member shank to support said lifting member in cantilevered relation with said formwork, (g) said attaching means comprising bosses which project from each of said plug elements adjacent said semi-circular wall thereof and are so configured that said bosses on each said element overlap with corresponding said bosses on the other said element in said assembly condition of said plug elements, and (h) each of said bosses having a hole therethrough which is aligned with said hole in the other said boss overlapped therewith in said assembly to receive a nail by which said assembly is attached to said formwork.

3. Apparatus as defined in claim 2 further comprising clip means on said hemispherical wall of said plug assembly for retaining reinforcing bar means in fixed spatial relation with the associated said lifting member and said formwork.

4. Apparatus as defined in claim 3 wherein said reinforcing bar means is of circular cross section and each said clip means defines an outwardly facing recess of cylindrical curvature.

5. Apparatus as defined in claim 3 wherein said clip means are located at four equally spaced positions around said plug assembly.

* * * * *

UNITED STATES PATENT AND TRADEMARK OFFICE

CERTIFICATE OF CORRECTION

PATENT NO. : 4,807,843

DATED : February 28, 1989

INVENTOR(S) : Peter D. Courtois et al

It is certified that error appears in the above—identified patent and that said Letters Patent is hereby corrected as shown below:

Column 7, line 22, "edges being" should be deleted.

Column 7, line 44, after "of" the word "inverted" Should be inserted.

Signed and Sealed this

Tenth Day of October, 1989

*Attest:*

DONALD J. QUIGG

*Attesting Officer*

*Commissioner of Patents and Trademarks*